United States Patent [19]

Lackner

[11] Patent Number: 4,877,432

[45] Date of Patent: Oct. 31, 1989

[54] DISPOSABLE DUST BAG FOR VACUUM CLEANERS AND THE LIKE

[75] Inventor: John R. Lackner, North Ridgeville, Ohio

[73] Assignee: The Scott Fetzer Company, Cleveland, Ohio

[21] Appl. No.: 208,735

[22] Filed: Jun. 17, 1988

[51] Int. Cl.[4] ..... B01D 46/02

[52] U.S. Cl. ..... 55/375; 15/349; 15/351; 55/377; 55/378; 55/DIG. 2; 55/DIG. 3

[58] Field of Search ..... 15/349, 351, 352; 55/374–378, DIG. 2; 285/7, 376, 401

[56] References Cited

U.S. PATENT DOCUMENTS

| | | | |
|---|---|---|---|
| 1,589,469 | 6/1926 | Homand | 285/376 X |
| 2,719,597 | 10/1955 | Brace | 55/375 |
| 2,868,321 | 1/1959 | Kelly | 55/376 X |
| 2,975,862 | 3/1961 | Goldberg . | |
| 3,150,405 | 9/1964 | Tissler | 15/351 |
| 3,417,550 | 12/1968 | Fesco | 55/376 |
| 3,869,751 | 3/1975 | Boyd et al. | 285/7 X |
| 3,933,451 | 1/1976 | Johansson | 55/367 |
| 4,262,384 | 4/1981 | Bowers | 55/375 X |
| 4,274,847 | 6/1981 | Crener | 55/374 |
| 4,281,895 | 8/1981 | Mohr | 285/401 X |
| 4,364,757 | 12/1982 | Leonatti | 55/377 X |
| 4,449,737 | 5/1984 | Specht | 285/7 |
| 4,514,199 | 4/1985 | Ford et al. | 55/375 X |
| 4,738,697 | 4/1988 | Westergren | 55/376 |

FOREIGN PATENT DOCUMENTS

| | | | |
|---|---|---|---|
| 2840628 | 3/1979 | Fed. Rep. of Germany | 55/DIG. 2 |
| 3403135 | 8/1985 | Fed. Rep. of Germany | 55/DIG. 2 |
| 2407731 | 7/1979 | France | 55/378 |
| 2119046 | 11/1983 | United Kingdom | 285/7 |

*Primary Examiner*—Robert Spitzer

*Attorney, Agent, or Firm*—Pearne, Gordon, McCoy & Granger

[57] ABSTRACT

A disposable dust bag for vacuum cleaners and the like is disclosed which includes a mounting collar adapted to be removably mounted on a vacuum cleaner connector through which dirt-laden air is delivered to the dust bag. The connector has a generally cylindrical outlet end and peripherally spaced projections extending from the outer surface thereof. The collar provides an opening sized to closely fit the outlet through the majority of its peripheral extent and which provides peripherally spaced enlarged portions adapted to clear the projections on the connector when the bag is installed and removed. The collar also provides an inwardly extending elastomeric diaphragm having a centrally located opening substantially smaller than the outlet of the connector. During installation and removal of the bag on the connector, the enlarged portions of the collar opening are aligned with the projections on the connector and the collar is pressed over the connector until it is positioned behind the projections. The collar is then rotated to a mounted or installed position in which it engages the rearward sides of the projections to secure the two members together. The elastomeric diaphragm tightly fits around the projections and forms a lip seal with the connector to prevent leakage of dirt-laden air back along the connector.

16 Claims, 2 Drawing Sheets

DISPOSABLE DUST BAG FOR VACUUM CLEANERS AND THE LIKE

BACKGROUND OF THE INVENTION

This invention relates generally to suction or vacuum cleaners, and more particularly to a novel and improved mounting structure for removably mounting disposable dust bags on such a cleaner.

PRIOR ART

It is well known to provide disposable dust or filter bags for vacuum cleaners. Such bags are usually formed of a porous paper and define a chamber in which dust and dirt are collected. When such bags have been used, they are removed and the bag and the dirt contained therein are discarded.

Because such bags are only used once and are discarded when full of dirt and dust, they must be economical to produce and market. However, the bags must be sufficiently durable to permit them to be installed and removed without damage. They must also provide a connecting and sealing structure for connecting the bag to the dirt-laden air discharge of the cleaner which is easily installed and which provides a reliable seal so that all of the dirt-laden air enters the filter bag.

It is known to provide such disposable dust bags with an inlet including a substantially rigid collar, formed of cardboard or plastic, and an elastomeric diaphragm which engages and provides a seal with a connector of the cleaner.

Examples of disposable dust bag mounting systems are illustrated in U.S. Letters Pat. Nos. 2,975,862; 3,150,405; 3,933,451; and 4,274,847. The latter of such patents disclose a mounting structure providing a rigid cardboard or plastic collar and a plastic diaphragm secured to the body of the dust bag around the inlet opening therein. The collar is provided with an opening having an enlarged portion which is sized to pass over a rib which extends around the end of the vacuum cleaner coupling. The collar opening also provides a portion of reduced size which fits behind the rib when the collar is shifted laterally to the mounted position. Because of the shifting movement required, the collar must be relatively large. Also, because the diaphragm tends to lock the collar in the mounted position, the removal of the bag after use can be difficult.

It is also known in the vacuum cleaner prior art to provide a hose coupling that is inserted and then rotated to a locked or mounted position. U.S. Letters Pat. No. 4,449,737 describes such a structure. All of the above-mentioned patents are incorporated herein by reference in their entirety to illustrate various prior art structures.

SUMMARY OF THE INVENTION

The present invention provides a novel and improved mounting system for disposable dust bags for vacuum cleaners and the like. The mounting system provides a low cost structure which is easily mounted and removed and which reliably provides a strong connection and a reliable seal.

The illustrated embodiment provides a vacuum cleaner connector having a generally cylindrical wall extending to an open end through which dirt-laden air is discharged by the vacuum cleaner fan. Peripherally spaced projections extend from the wall substantially adjacent to the open end thereof. The dust bag is provided with a substantially rigid collar and an elastomeric diaphragm. The collar provides an opening therein having portions of reduced diameter sized to closely fit the outer surface of the connector wall and enlarged peripherally spaced portions sized to pass back and forth past the connector projections when the bag is in a mounting and removal position.

During mounting, the collar is moved onto the connector, with the connector projections aligned with the enlarged portions of the collar opening, and is then rotated relative to the connector, causing the portions of reduced diameter to move in behind the connector projections to securely lock the collar on the connector. Removal of the bag is accomplished by reversing the direction of rotation back to the mounting and removal position, after which the bag is removed.

The elastomeric diaphragm is provided with a centrally located opening having a diameter substantially smaller than the end of the coupling, and is adhesively secured to the collar entirely around the collar opening. In fact, in the illustrated embodiment, the collar is formed of two layers of stiff cardboard with a diaphragm sandwiched therebetween.

As the collar is pressed past the connector projections, the diaphragm is stretched over the projections and the collar is rotated to the locked position. When in the locked position, the diaphragm stretches outwardly along the back side of the projections and extends forwardly over the projections and then inwardly along the forward face of the projections. This engagement between the diaphragm and the projections provides a tight fit and ensures that during use the collar remains in the locked position. The opening in the diaphragm is initially sized so that the diaphragm extends inwardly along a substantial portion of the end of the connector wall with a tight fit. The diaphragm provides an effective lip seal which prevents air pressure within the bag from causing leakage back along the exterior of the coupling. The lip seal is also provided along any portions of the diaphragm which extend back along the outer cylindrical surface of the coupling so that a reliable seal is provided.

In the illustrated embodiment, the bag itself is a vertically extending, elongated bag, and the inlet is spaced both from the upper and lower ends of the bag. As the dirt and dust collect within the bag, it tends to collect within the lower portion below the inlet, leaving the upper portion of the bag substantially clear so that the air can pass out of the bag without developing a high back pressure which would substantially decrease the effectiveness of the cleaner. When the dirt collected within the bag approaches the level of the inlet of the bag, the bag, with the dirt therein, is removed and discarded so that a new, empty bag can be installed.

These and other aspects of this invention are illustrated in the accompanying drawing, and are more fully described in the following specification.

DETAILED DESCRIPTION OF THE DRAWINGS

Figure 1:
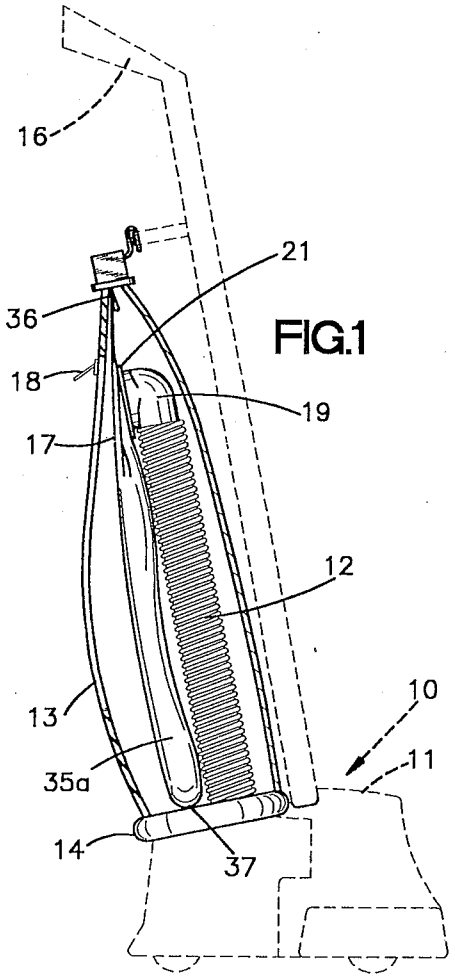
FIG. 1 is a schematic illustration of a vacuum cleaner with a disposable dust bag incorporating this invention installed thereon.

FIG. 1 schematically illustrates a disposable dust bag and mounting system incorporating the present invention applied to a typical upright vacuum cleaner 10. The vacuum cleaner 10 includes a motor and fan housing assembly 11. Such cleaners are particularly adapted for carpet and rug cleaning, and in many instances can be provided with various types of attachments for other types of cleaning operations.

In this illustrated embodiment, dirt-laden air is discharged by the fan through a flexible hose 12 which extends upwardly from the housing assembly 11 within a cloth dust bag 13. The dust bag 13 is connected at 14 to the housing assembly 11, and is supported at its upper end from the handle 16 of the vacuum cleaner. A disposable dust bag 17 incorporating the present invention is installed during use within the cloth dust bag 13. Normally, the cloth dust bag 13 is provided with a zipper 18 which can be opened to provide access for the mounting and removal of the disposable dust bag 17.

Mounted on the upper end of the flexible hose 12 is a connector 19 which is connected to the disposable dust bag 17, as described in greater detail below, and through which dirt-laden air passes into the disposable dust bag 17. The dust bag 17 is provided with a mounting collar 21 which is removably mounted to the connector 19 so that all of the dirt-laden air from the cleaner enters the dust bag where the dirt is collected.

Figure 2:
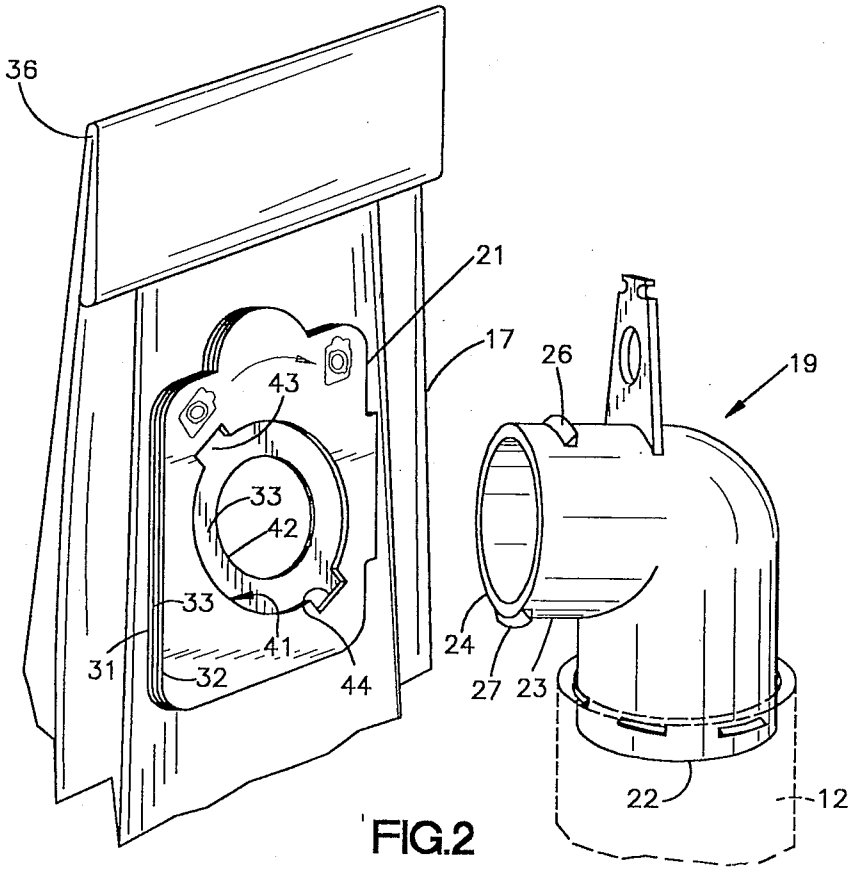
FIG. 2 is a fragmentary, perspective view, illustrating the vacuum cleaner connector and the dust bag prior to the mounting of the dust bag.

The overall structure of the connector 19 and the mounting collar of the disposable dust bag 17 is best illustrated in FIG. 2. The connector 19, in the illustrated embodiment, is a molded plastic part providing a generally cylindrical inlet 22 connected by suitable means to the flexible hose 12. The dirt-laden air enters the connector 19 through the inlet 22 of the connector 19 and is discharged through a generally cylindrical outlet portion 23, which in the illustrated embodiment extends at right angles to the inlet 22.

Figure 3:
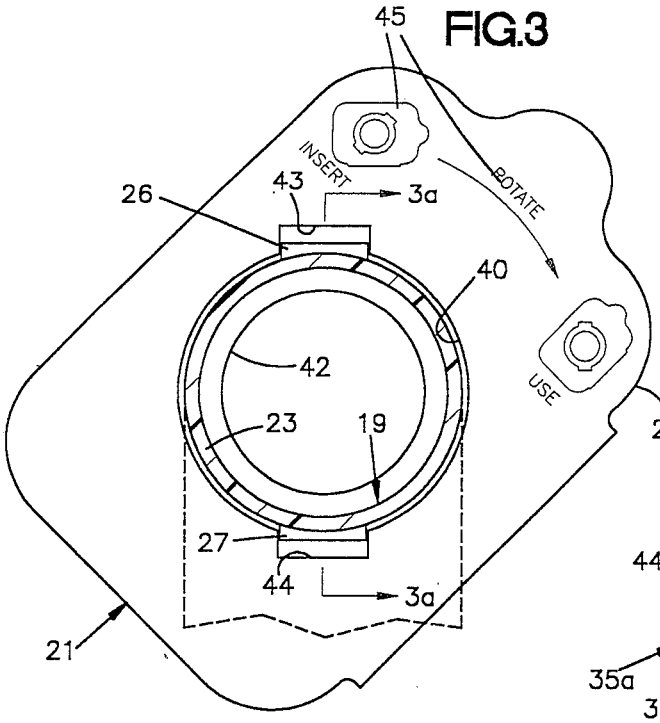
FIG. 3 is a side elevation, partially in section, illustrating the connector and dust bag in the mounting and removal position.
Figure 3A:
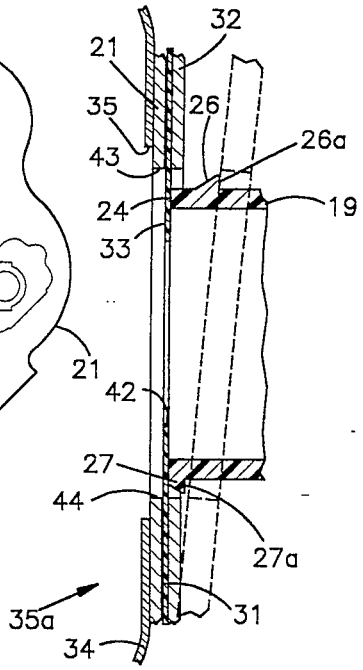
FIG. 3a is a fragmentary view, taken along line 3a–3a of FIG. 3.
Figure 4:
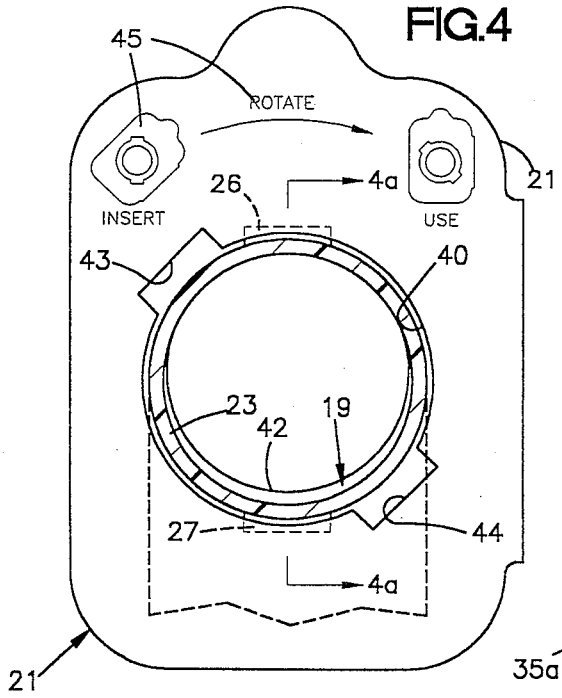
FIG. 4 is a side elevation, partially in section, illustrating the connector and dust bag in the fully mounted and locked position.
Figure 4A:
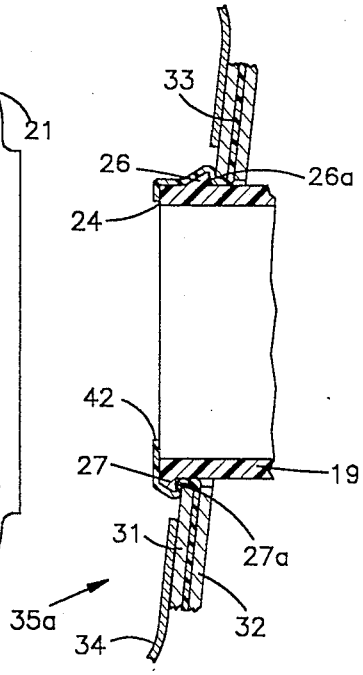
FIG. 4a is a fragmentary section, taken along line 4a–4a of FIG. 4.

Substantially adjacent to the end 24 of the outlet portion 23, the connector is provided with a pair of peripherally spaced mounting projections 26 and 27, which cooperate with the collar to securely mount the collar on the connector 19 when the dust bag 17 is mounted thereon. As best illustrated in FIGS. 3a and 4a, the rearward walls 26a and 27a of the projections 16 and 27, respectively, extend radially and the forward walls are inclined.

The mounting collar 21, in the illustrated embodiment, includes two layers 31 and 32 of stiff, substantially rigid cardboard, which are laminated with adhesive to opposite sides of an elastomeric diaphragm 33. The layer of cardboard 31 is also adhesively secured to the wall 34 of the disposable dust bag around the inlet 35 therein. The dust bag is formed of an air-permeable paper material of the general type used in the past to form disposable dust bags for vacuum cleaners and the like, and is folded and seamed to define an elongated bag structure which defines a chamber 35a in which the dirt is collected.

Preferably, the mounting collar 21 is located at a location spaced from the upper end 36 and the lower end 37 of the dust bag. In use, the dirt-laden air enters the bag from the connector 19 through the inlet 35, and the material forming the bag allows the air to pass out through the bag 17 and the cloth dust bag 13 to the environment while preventing the passage of the particles of dirt entrained within the air. Such dirt tends to collect in the lower part of the bag and because the inlet is spaced from the upper end 36 of the bag, the upper portion of the bag remains relatively clear of collected dirt so that substantially free passage of the air occurs from the dust bag. In normal use, the dust bag is removed and discarded along with the dirt collected therein when the level of the dirt approaches the level of the inlet at the mounting collar. By providing the inlet at a location below the upper end of the dust bag, the tendency for back pressure to be built up during the use of the cleaner is minimized and the efficiency of the cleaner is maintained until the bag is substantially filled to the level of the inlet provided by the collar 21.

Referring to FIGS. 2 to 4a, the two layers 31 and 32 of the mounting collar 21 are formed with identical openings 41 therein and the diaphragm 33 is formed with a circular opening 42 which is substantially smaller than the openings 41 in the two collar layers 31 and 32.

The openings 41 are circular, except for two radially extending, enlarged portions 43 and 44, which are sized and positioned to clear the projections 26 and 27 when the collar is installed on and removed from the connector 19.

In the illustrated embodiment, the projections 26 and 27 are located on the top and bottom of the outlet portion of the connector 19 and the enlarged portions 43 and 44 are oriented with respect to the length of the bag at about 45 degrees. During installation and removal of the disposable bag, the collar is oriented in an angled position in which the two enlarged portions 43 and 44 are aligned with the mounting projections 26 and 27, respectively, as best illustrated in FIGS. 3 and 3a. This is the mounting and removal position of the collar 21 with respect to the connector 19. In such position, the collar 21 is initially moved to the position illustrated in FIG. 3a, in which the diaphragm 33 engages the end 24 of the connector 19, and the circular portions 40 of the opening 41 in the two layers 31 and 32 align with and closely fit the exterior surface of the outlet portion 23 of the connector. Further, the projections 26 and 27 are aligned with the enlarged portions 43 and 44, respectively.

During the mounting of the bag on the connector, the mounting collar 21 is pushed from the full-line position illustrated in FIG. 3a to the phantom-line position, in which the collar extends behind the projections 26 and 27. The collar is then rotated relative to the connector 19 to the fully mounted position illustrated in FIGS. 4 and 4a. In such position, the circular portions 40 of the collar are positioned behind the two projections 26 and 27, engaging the rearward walls 26a and 27a. Therefore, the collar is locked onto the connector.

As best illustrated in FIG. 3a, the diaphragm opening 42 is substantially smaller than the end of the connector 19 so that as the mounting collar is pressed over the end of the connector 19, the diaphragm is stretched to the position illustrated in FIG. 4a, in which the diaphragm extends outwardly along the rearward sides 26a and 27a of the adjacent projections 26 and 27 and inwardly along the forward side of each projection. In the illustrated embodiment, the projection 26 is spaced back from the end 24 of the connector 19 and the projection 27 is substantially adjacent thereto. Consequently, the collar in its mounted position is inclined to some extent with respect to a plane perpendicular to the outlet portion 36.

As best illustrated in FIG. 4*a*, the diaphragm is stretched around the exterior wall of the outlet portion 23 and also extends in along the end 24 of the connector 19.

Because the projection 27 is located substantially at the end 24, the diaphragm along that portion of the connector extends inwardly a small distance beyond the end 24 but, adjacent to the projection 26, the diaphragm engages the end 24 to a lesser extent. In any event, this engagement between the diaphragm and the exterior wall of the connector 19 and along the end 24 thereof provides a lip seal which ensures that a fluidtight joint is provided between the disposable dust bag 17 and the connector. This ensures that all of the dirt-laden air passes into the disposable dust bag and that no leakage occurs. By sizing the opening 42 in the diaphragm substantially smaller than the end 24 of the connector, it is ensured that the diaphragm maintains this lip seal and does not blow through and invert during the operation of the cleaner.

Further, the diaphragm provides a very snug mechanical contact with the end of the connector which frictionally maintains the dust bag in its mounted position and during the use of the cleaner.

When the level of dirt collected in the dust bag reaches substantially to the level of the inlet provided by the mounting ring, the dust bag is rotated in the opposite direction to again bring the enlarged portions 43 and 44 into alignment with the associated projections 26 and 27 and the dust bag is easily removed from the connector for disposal. Subsequently, a new, empty disposable dust bag is installed and cleaning operations can be continued.

The rotation of the collar and diaphragm with respect to the end connector during the mounting and removal of the disposable dust bag, as mentioned above, is resisted by the frictional engagement between the diaphragm and the end of the connector 19. However, such friction is not difficult to overcome and the mounting and removal of the dust bag on the connector are easily accomplished by the user. However, such friction is sufficient to reliably prevent rotation of the collar-back to the removal position during the use of the cleaner.

Preferably, the face of the collar is provided with printed indicia 45 to indicate the proper position for the mounting of the dust bag on the collar and for its removal.

With the present invention, a low-cost. reliable structure is provided which can be easily installed and removed by the user, and which ensures that a good seal is provided between the dust bag and the connector.

Although the preferred embodiment of this invention has been shown and described, it should be understood that various modifications and rearrangements of the parts may be resorted to without departing from the scope of the invention as disclosed and claimed herein.

What is claimed is:

1. A vacuum cleaner providing a connector through which dirt-laden air is discharged, said connector providing a generally cylindrical wall portion having an end and peripherally spaced outwardly extending projections substantially adjacent to said end, a disposable dust bag formed of permeable sheet material defining a dust collection chamber, an inlet in said dust bag providing a substantially rigid collar having an opening therein proportioned to fit over said connector and said projections when in a mounting and removal position, said collar being rotatable relative to said connector from said mounting and removal position to an installed position in which portions of said collar engage the sides of said projections remote from said end, and an elastomeric seal around said inlet providing a generally circular opening, said seal extending past said projections from the sides thereof remote from said end to the side of said projections adjacent said end and include airtight sealing engagement with the surface of said connector on the side of said projections adjacent to said end, said seal forming an airtight seal between said dust bag and said connector when said collar is in said installed position, said seal resisting rotation of said collar relative to said connector from said installed positions toward said mounting and removal positions.

2. A vacuum cleaner as set forth in claim 1, wherein said elastomeric seal is a thin diaphragm mounted on said collar and extending inwardly into said opening in said collar, said diaphragm forming a lip seal with said connector when said collar is in said installed position.

3. A vacuum cleaner as set forth in claim 2, wherein said diaphragm provides a substantially circular opening smaller than said end of said connector and engages at least a portion of said end of said connector when said collar is in said installed position.

4. A vacuum cleaner as set forth in claim 3, wherein said diaphragm is stretched tightly over said projections when said collar is in said installed position.

5. A vacuum cleaner as set forth in claim 4, wherein there are at least two of said projections, one of said projections being spaced from said end of said connector a greater distance than the other of said projections.

6. A disposable vacuum cleaner dust bag comprising a porous sheet defining a dust collection chamber, an inlet open to said chamber, a substantially rigid collar secured to said sheet around said inlet, said collar providing a generally circular opening having peripherally spaced outwardly extending portions, an elastic diaphragm on said collar providing a generally circular opening smaller than said opening in said collar, said collar being adapted to mount on a connector having a generally cylindrical outlet portion having an end through which dirt-laden air is delivered by a vacuum cleaner and which provides peripherally spaced outwardly extending projections, said collar being adapted to be installed and removed when in a first position in which said outwardly extending portions are aligned with said projections and being rotatable relative to said connector to an installed position in which said collar extends behind said projections to secure said collar on said connector, said diaphragm being adapted to extend past said projections from the side thereof remote from said end to the side of said projections adjacent to said end and into engagement with the surface of said connector on the side of said projections adjacent said end to provide an airtight lip seal with said connector when said collar is in said installed position.

7. A dust bag as set forth in claim 6, wherein said diaphragm is adapted to stretch over said projections and resist rotation of said collar relative to said connector from said installed position.

8. A dust bag as set forth in claim 7, wherein said diaphragm is adapted to engage the end of said connector when said collar is in said installed position to form a lip seal with said connector and prevent said diaphragm from blowing through said collar when exposed to air pressure.

9. A disposable vacuum cleaner dust bag mounting system comprising a flexible body of air-permeable sheet material defining a dust collection chamber having an inlet, a connector providing an annular wall surrounding a passage and having an end adapted to be connected to a vacuum cleaner through which dirt-laden air is delivered to said chamber, said annular wall being provided with peripherally spaced projecting portions providing radially extending rearwardly facing surfaces, said bag providing mounting means surrounding said inlet including an elastomeric diaphragm and a substantially rigid collar, said collar having an opening therein having portions sized to engage said rearwardly facing surfaces when said bag is in a mounted position on said coupling, said collar also providing enlarged portions sized to clear said projecting portions allowing movement of said collar past said projecting portions when in an installation and removal position, said collar being rotatable relative to said coupling between said installation and removal position and said mounted position, said diaphragm providing an opening therein aligned with said end of said coupling sized to be stretched past said projections from the sides thereof remote from said end to the sides of said projections adjacent to said end and into airtight sealing engagement with said annular wall on the side of said projections adjacent said end, said diaphragm engaging said annular wall and resisting said rotation of said collar from said mounted position.

10. A dust bag mounting system as set forth in claim 9, wherein said projecting portions are provided by peripherally spaced projections extending outwardly from said annular wall.

11. A dust bag mounting system as set forth in claim 10, wherein said collar is formed of substantially rigid material.

12. A dust bag mounting system as set forth in claim 9, wherein said annular wall is a substantially cylindrical wall and said projecting portions are projections extending outwardly from said annular wall, said opening in said collar being generally circular between said enlarged portions and being sized to closely fit around said cylindrical wall between said enlarged portions.

13. A dust bag mounting system as set forth in claim 12, wherein said diaphragm provides an opening substantially smaller than said cylindrical wall, said diaphragm stretching over said projections and engaging at least part of said end to provide a lip seal with said connector.

14. A dust bag mounting system as set forth in claim 13 wherein said chamber is an elongated vertically extending chamber having ends, and said collar is spaced from said ends of said chamber.

15. A dust bag mounting system as set forth in claim 14 wherein said collar is provided with indicia indicating the orientation of said collar relative to said connector in said installation and removal positions and also indicating the orientation between said collar and said connector when said collar is in said mounted position.

16. A vacuum cleaner comprising a frame including a handle, an elongated nondisposable dust bag formed of air-permeable flexible material mounted on said frame and supported in an upright position by said handle, a connector within said nondisposable bag through which dirt-laden air is discharged, said connector providing a generally cylindrical wall portion extending to an end and providing peripherally spaced outwardly extending projections substantially adjacent to said end, an elongated disposable dust bag formed of permeable flexible sheet material defining a dust collection chamber, an inlet in said disposable dust bag providing a substantially rigid collar having an opening therein proportioned to fit over said connector and said projections when in a mounting and removal position, said collar being rotatable relative to said connector from said mounting and removal position to an installed position in which portions of said collar engage the sides of said projections remote from said end, and an elastomeric seal around said inlet providing a generally circular opening, said seal extending past said projections from the sides thereof remote from said end to the sides of said projections adjacent to said end and into tight sealing engagement with the surface of said connector on the sides of said projections adjacent said end, said seal forming an airtight seal between said dust bag and said connector when said collar is in said installed position, the length of said disposable dust bag being aligned with the length of said nondisposable dust bag when said collar is in said installed position relative to said connector, rotation of said collar to said mounting and removal positions requiring rotation of said collar to positions tending to cause said disposable dust bag to be moved to positions misaligned with said nondisposable dust bag.

* * * * *